US006494922B1

(12) United States Patent
Rhyne et al.

(10) Patent No.: US 6,494,922 B1
(45) Date of Patent: Dec. 17, 2002

(54) APPARATUS AND METHOD FOR WRAPPING OF FINE DENIER YARNS SPACE DYEING AND SUBSEQUENTLY UNWRAPPING THE FINE DENIER YARNS FOR FURTHER PROCESSING, INTERMEDIATE YARN PRODUCT AND SPACE-DYED FINE DENIER YARN

(75) Inventors: Jeffrey T. Rhyne, Mt. Holly, NC (US); Jack G. Haselwander, Chattanooga, TN (US)

(73) Assignee: Belmont Textile Machinery Co., Inc., Mount Holly, NC (US)

( * ) Notice: Subject to any disclaimer, the term of this patent is extended or adjusted under 35 U.S.C. 154(b) by 0 days.

(21) Appl. No.: 09/444,639

(22) Filed: Nov. 22, 1999

Related U.S. Application Data

(60) Provisional application No. 60/109,605, filed on Nov. 23, 1998.

(51) Int. Cl.[7] ..... D06B 3/01

(52) U.S. Cl. ..... 8/149.1; 8/151.2; 68/13 R; 68/200

(58) Field of Search ..... 8/149, 149.1, 151.2; 68/200, 203, 13 R; 57/207, 210

(56) References Cited

U.S. PATENT DOCUMENTS 2,022,025 A * 11/1935 Bradfors, Jr.
3,427,647 A * 2/1969 Field, Jr.
3,456,431 A * 7/1969 Fleissner ..... 8/151.2
3,675,409 A * 7/1972 Rosenstein
3,692,466 A * 9/1972 Mercer ..... 8/151.2
3,869,850 A * 3/1975 Gross
4,005,590 A * 2/1977 McLean
4,018,042 A * 4/1977 Maag et al.
4,042,989 A * 8/1977 Drago et al. ..... 8/151.2
4,303,092 A * 12/1981 Bridges et al.
4,391,665 A * 7/1983 Mitchell, Jr. et al.
4,571,765 A * 2/1986 Okada et al.
5,047,104 A * 9/1991 Preis et al.
5,076,809 A * 12/1991 Bouglas ..... 8/151.2
5,498,459 A * 3/1996 Mokhta et al.
5,594,968 A * 1/1997 Haselwander et al.

FOREIGN PATENT DOCUMENTS

JP 3-249231 * 11/1991

* cited by examiner

*Primary Examiner*—Frankie L. Stinson
(74) *Attorney, Agent, or Firm*—Adams, Schwartz & Evans, P.A.

(57) ABSTRACT

A method and apparatus for space-dyeing yarns, particularly fine denier yarns, including the steps of wrapping a plurality of feed yarns with a sacrificial wrapper yarn to form a composite yarn bundle, space-dyeing the composite yarn bundle, removing the wrapper yarn from around the feed yarns, and separating the feed yarns into individual yarns for further processing. An intermediate yarn product for passing through the space-dyeing machine is disclosed, as well as the end product fine denier yarns after being separated from the bundle in which dyeing took place.

33 Claims, 5 Drawing Sheets

APPARATUS AND METHOD FOR WRAPPING OF FINE DENIER YARNS SPACE DYEING AND SUBSEQUENTLY UNWRAPPING THE FINE DENIER YARNS FOR FURTHER PROCESSING, INTERMEDIATE YARN PRODUCT AND SPACE-DYED FINE DENIER YARN

This application is based upon Provisional Application Ser. No. 60/109,605, filed Nov. 23, 1998, priority from which is hereby claimed.

TECHNICAL FIELD AND BACKGROUND OF THE INVENTION

This invention relates to a process for space-dyeing fine denier yarns. In general, the process involves wrapping fine denier yarns with a wrapper yarn before space dyeing the composite bundle of yarns, and subsequently unwrapping the fine denier yarns for further processing as individual yarns. The invention also relates to an apparatus for wrapping of fine denier yarns for space dyeing and subsequently unwrapping the fine denier yarns for further processing, an intermediate yarn product formed of bundled fine denier yarns suitable for space-dyeing in a continuous process, and an end product, fine denier yarn which results from the process carried out on the intermediate yarn product.

Continuous dye lines are typically used for space-dyed carpet yarns. Carpets are typically tufted from yarns in the 1000–3000 denier range. However, there is a large potential market for space dyed fine denier yarns to be used in end uses such as automotive upholstery. Typically the denier range for this type of space-dyed yarns is 150 to 500 denier. Some automotive upholstery fabric is spaced-dyed using a proprietary needle injection dye process. Quality problems with this process are significant and typically result in dye spot length differences between the outside of the package and the inside, or core, of the package. This can cause significant pattern repeat defects in the finished fabric. Some fabric manufactures typically back-wind 1 package, and then parallel wind the back-wound yarn with another space dye yarn just to hide the pattern repeat defects. This can require that a significant percentage of the yarn be scrapped, since a good portion of the core yarn on each package is not dyed the same shade as the rest of the package.

Five hundred denier continuous filament polyester can be space-dyed in a continuous process. However, this fine denier yarn is very fragile and can cause problems in subsequent processing, for example, trying to separate the yarn ends from the coil and get them onto a yarn package at the winder. Of course, the problem would be even greater with yarns as fine as 150 denier.

Productivity issues are also present. Applicant's applicator, dye line and winder are set up to run at a maximum speed of 500 YPM with 48 running yarn ends. With these speeds, running 150 denier yarn would not be economically practical because of lack of productivity.

Consideration has been given to many ways to get a sufficient number of ends through the dye line so that productivity would rise to the level of commercial practicability. For example, consideration has been given to the concept of dyeing the yarn, but not coiling so that it could be wound without having to separate the yarn from the coiled form. However, if the yarn isn't coiled or compacted in some manner there is no way to obtain adequate time for steam fixation washing, drying, and so forth.

Yarn wrapping per se is a conventional process. However, known prior art uses of this process involve wrapping a yarn to achieve a wrapped end product. To applicant's knowledge, the prior art does not disclose the formation of an intermediate yarn product which is processed, whereupon the intermediate yarn product is disassembled into its constituent, end use parts with the wrapper yarn being sacrificed.

SUMMARY OF THE INVENTION

Therefore, it is an object of the invention to provide a process for space-dyeing fine denier yarns in a series of steps.

It is another object of the invention to provide a process for space-dyeing fine denier yarns in a continuous process.

It is another object of the invention to provide a process for space-dyeing fine denier yarns while bundled together to form a yarn of sufficient size and strength to withstand the space-dyeing processing conditions.

It is another object of the invention to provide a process for space-dyeing fine denier yarns wherein a sacrificial wrapper yarn is used to form a yarn bundle of sufficient size to be dyed in a efficient and productive manner.

These and other objects of the present invention are achieved in the preferred embodiments disclosed below by providing a method for space-dyeing yarns, comprising the steps of wrapping a plurality of feed yarns with a sacrificial wrapper yarn to form a composite yarn bundle, space-dyeing the composite yarn bundle, removing the wrapper yarn from around the feed yarns, separating the feed yarns into individual yarns for further processing.

According to one preferred embodiment of the invention, the method includes the step of winding the composite yarn bundle onto a yarn package after the space-dyeing step.

According to another preferred embodiment of the invention, the step of removing the wrapper yarn from around the feed yarns comprises the step of unwrapping the wrapper yarn from around the feed yarns.

According to yet another preferred embodiment of the invention, the step of removing the wrapper yarn from around the feed yarns comprises the step of cutting the wrapper yarn away from the feed yarns.

A further embodiment of the method according to the invention comprises the steps of spreading the composite yarn bundle to expose the wrapper yarn in advance of the feed yarns to a blade and cutting the wrapper yarn away from the feed yarns at a point in advance of the feed yarns.

According to yet another preferred embodiment of the invention, the method includes the step of aspirating the cut wrapper yarn to remove it from the feed yarns.

According to yet another preferred embodiment of the invention, the method includes the step of winding the separated feed yarns onto individual yarn packages.

According to one preferred embodiment of the invention, the process steps are carried out in a continuous process on a single apparatus having a series of process stations.

According to another preferred embodiment of the invention, the process steps are carried out in a series of discrete steps on separate machines.

According to yet another preferred embodiment of the invention, the steps of coiling, steaming and dyeing the composite yarn bundle take place after space-dyeing and before separating the wrapper yarn from the feed yarns.

According to yet another preferred embodiment of the invention, each of the plurality of feed yarns comprises a synthetic yarn having a denier of 500 or less.

According to yet another preferred embodiment of the invention, each of the plurality of feed yarns comprises a synthetic yarn having a denier of 150 or less.

According to yet another preferred embodiment of the invention, the step of wrapping a plurality of feed yarns with a sacrificial wrapper yarn comprises the step of wrapping the feed yarns with between 2 and 10 wraps of the wrapper yarn per inch.

According to yet another preferred embodiment of the invention, the wrapper yarn comprises a yarn having a denier of between 20 and 150 denier.

According to yet another preferred embodiment of the invention, the step of space-dyeing the composite yarn bundle comprises the step of passing the composite yarn bundle through a plurality of yarn-dyeing stations, each of said yarn dyeing stations including a rotatable pattern member permitting a dye to be applied to the yarn in seriatim only when disposed in a selected angular disposition relative to said yarn bundle, each pattern member being associated with a different color dye, the speed of each member controlling the angle through which each of the members rotates during repetitive time periods so that the disposition required to permit dyeing of yarn by each color may be obtained at selected times.

According to yet another preferred embodiment of the invention, the method includes the step of coordinating the location along the yarn bundle at which each member permits dye to be applied, whereby each different color dye may be applied along different amounts of the yarn bundle and at selected locations.

According to yet another preferred embodiment of the invention, the step of space-dyeing the composite yarn bundle comprises the steps of feeding said yarn bundle in one direction through said stations, locating a dye applying means at each station for applying dye of a selected color onto said yarn bundle, locating a rotatable pattern member at each station for selectively permitting and preventing dye to be applied to said yarn bundle by the respective dye applying means, and controllably rotating each pattern member independently of the other pattern members in accordance with a pattern to selected positions to permit dye to be applied to said yarn at selected times and to prevent dye to be applied to the yarn at other times. An apparatus for space-dyeing yarns in accordance with the invention comprises a yarn-wrapping apparatus for wrapping a plurality of feed yarns with a sacrificial wrapper yarn to form a composite yarn bundle, a space-dyeing apparatus for space-dyeing the composite yarn bundle, a wrapper yarn removal apparatus for removing the wrapper yarn from around the feed yarns, and a feed yarn separating apparatus for separating the feed yarns into individual yarns for further processing.

According to yet another preferred embodiment of the invention, the invention includes a winder for winding the composite yarn bundle onto a yarn package after the space-dyeing step.

According to yet another preferred embodiment of the invention, the apparatus for removing the wrapper yarn from around the feed yarns comprises an apparatus for unwrapping the wrapper yarn from around the feed yarns.

According to yet another preferred embodiment of the invention, the apparatus for removing the wrapper yarn from around the feed yarns comprises a cutter blade for cutting the wrapper yarn away from the feed yarns.

According to yet another preferred embodiment of the invention, the apparatus for removing the wrapper yarn from around the feed yarns includes a yarn bundle spreader for spreading the composite yarn bundle to expose the wrapper yarn in advance of the feed yarns to a blade and wherein the cutter blade cuts the wrapper yarn away from the feed yarns at a point in advance of the feed yarns.

Another embodiment of the apparatus for space-dyeing yarns comprises yarn wrapping means for wrapping a plurality of feed yarns with a sacrificial wrapper yarn to form a composite yarn bundle, space-dyeing means for space-dyeing the composite yarn bundle, wrapper yarn removal means for removing the wrapper yarn from around the feed yarns; and separator means for separating the feed yarns into individual yarns for further processing.

According to one preferred embodiment of the invention, winding means are provided for winding the composite yarn bundle onto a yarn package after the space-dyeing step. m According to yet another preferred embodiment of the invention, wrapper removal means are provided for removing the wrapper yarn from around the feed yarns comprises the step of unwrapping the wrapper yarn from around the feed yarns.

According to yet another preferred embodiment of the invention, the wrapper yarn removal means comprises a cutter blade for cutting the wrapper yarn away from the feed yarns.

A composite yarn bundle for permitting space-dyeing of fine denier yarns according to the invention comprises a plurality of fine denier feed yarns integrated together in parallel configuration to form an integrated core, and a sacrificial wrapper yarn wrapped around the core to form a composite yarn bundle wherein the feed yarns are maintained in integrated condition during space-dyeing, said sacrificial wrapper adapted to be removed from around the feed yarns after space-dyeing to permit separation of the core into individual feed yarns for subsequent processing.

According to yet another preferred embodiment of the invention, each of said feed yarns is 500 denier or less.

According to yet another preferred embodiment of the invention, each of said feed yarns is 150 denier or less.

According to yet another preferred embodiment of the invention, each of said feed yarns is 50 denier or less.

According to yet another preferred embodiment of the invention, the wrapper yarn is 50 denier or less.

According to yet another preferred embodiment of the invention, the wrapper yarn is wrapped onto the core with between 2 and 10 wraps per inch.

A space-dyed, fine denier yarn according to the invention comprises a feed yarn of no more than 500 denier, a plurality of colors of dye applied to the feed yarn by moving the feed yarn past a dye-applying apparatus while integrated together with a plurality of like feed yarns by means of at least one sacrificial wrapper yarn wrapped around said feed yarns to maintain the feed yarns in their integrated condition, said wrapper yarn being removed from the feed yarn after space-dyeing.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Referring now specifically to the drawings, a process for space-dyeing fine denier yarns is shown. The term "fine denier feed yarns" as used herein refers to yarns having a denier from between 50 to 500 denier, and may be formed from any synthetic staple or continuous filament fiber, such as polyester or nylon.

Figure 1:
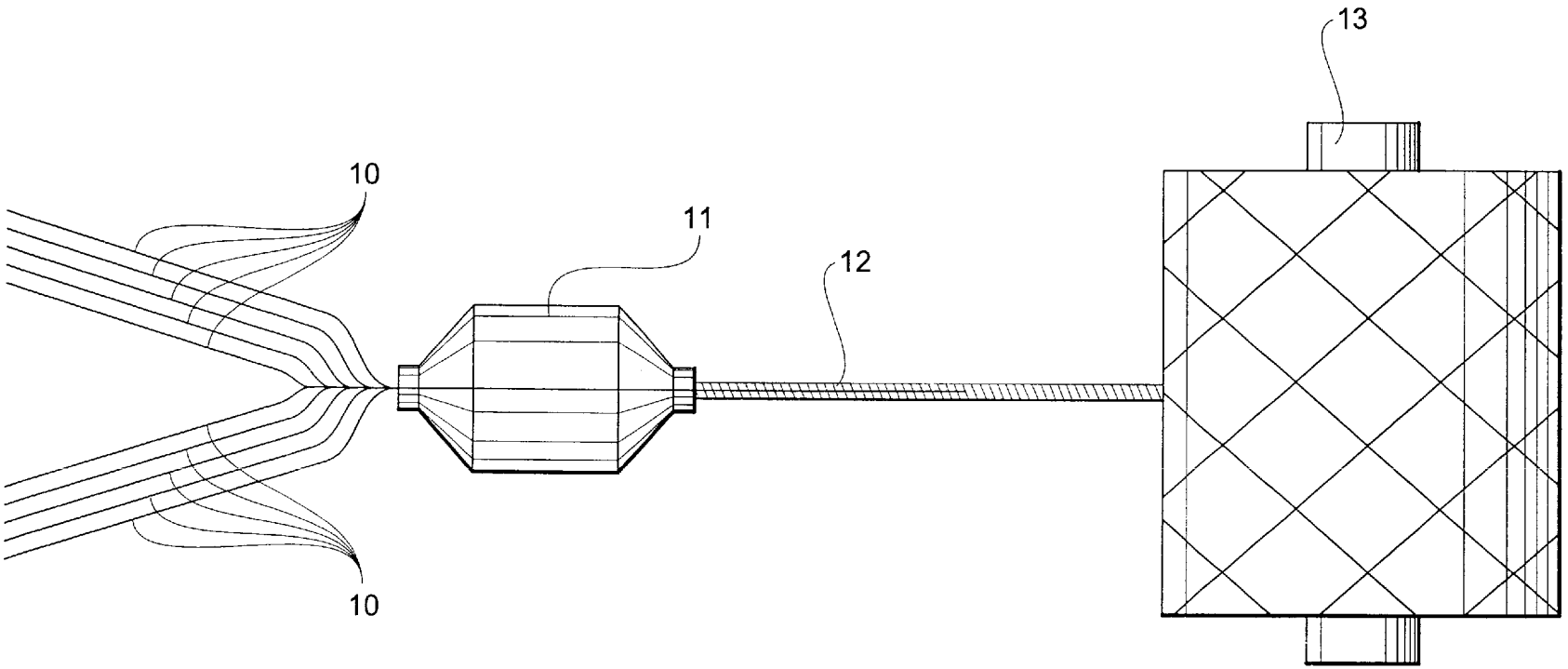
FIG. 1 is a schematic flow diagram of an apparatus for space-dyeing fine denier yarns, showing the feed yarns being wrapped into a bundle.

As is shown in FIG. 1 by way of example, 10 ends of 150 denier feed yarn 10 form a core and are wrapped with a 40 denier sacrificial wrapper yarn 11 to form an intermediate yarn product in the form of a 1500 denier composite yarn bundle 12 which can be conventionally space-dyed. The yarn bundle 12 is then wound onto a conventional yarn package 13. The number of wraps should be as low as possible and only just sufficient to keep the fine denier feed yarns bundled together for dyeing. Wraps in the range of from 2 to 10 wraps per inch should be suitable. This results in a yarn very similar to the size of carpet yarn, which is routinely space-dyed with excellent results.

Several devices can be used to wrap the sacrificial wrapper yarn 11 around the feed yarns 10.

Figure 2:
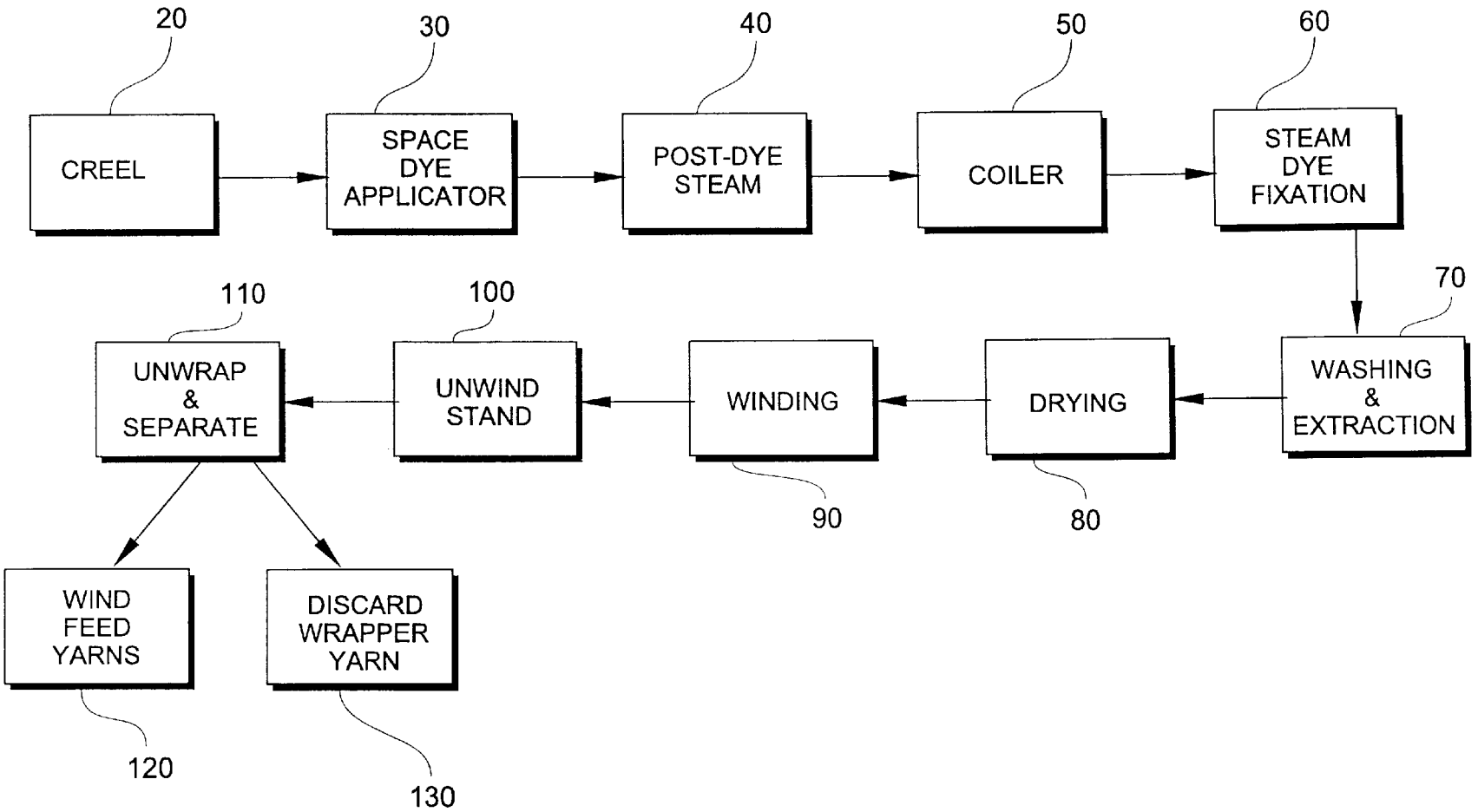
FIG. 2 is a schematic flow diagram showing the bundles being dyed and then rewound.

Referring now to FIG. 2, the proper number of packages 13 of composite yarn bundles 12, for example, 36 to 48, are put in the creel 20 of the dyeing machine 30 and space-dyed. The efficiency and robustness of the dyeing process may even be better than with carpet yarn, as the composite yarn bundle 12 is quite strong. In the event of a break-out of the feed yarns 10 while being transported to the winder, the feed yarns 10 can be retied as bundles, as the wrapper yarn 11 would not be lost. The space-dyeing process includes applying post-dye steam at a steamer 40, coiling the ccc at a coiler 50, fixing the dye with steam at a steamer 60, washing and extracting water at a washer/extractor 70 drying the ccc in a dryer 80, and then winding the ccc onto yarn packages in a conventional winder 90, such as a Belmont AD-30 or AD-35, or a Superba BLA or B400.

The space-dyeing process can be carried out by any conventional means. Applicant's space-dyeing process includes a series of dye stations, each of which has a dye applicator roll and a rotatable pattern roll having deflecting rods which deflect yarn into engagement with the periphery of the respective dye applicator roll as they rotate. Each pattern roll is rotatably driven by a servo motor and selectively rotated to position the deflecting rods for permitting dyeing to occur at the respective station and to rotate the roll and thus the rods to angular positions where the yarn is not deflected. A programmable controller directs the respective motors to the selected angular positions at precise times to start and stop the application of dye to the yarn. The controller is informed of the speed of the yarn movement so that rotation of each pattern roll is in timed relationship with the movement of the yarn. See, U.S. Pat. No. 5,594,968, which is incorporated herein by reference. An earlier embodiment of this space-dyeing arrangement is disclosed in U.S. Pat. No. 5,339,658, also incorporated herein by reference.

Other space-dyeing machines which may be used include a space-dyeing machine manufactured by Superba, S. A. which includes a series of dye stations, each of which has a dye applicator nozzle and a rotatable pattern disk having openings which permits and prevents dye from the nozzle to reach the moving yarn as the disks rotate. Each pattern disk is rotatably driven by a servo motor and selectively rotated to position the disk for permitting dyeing to occur at the respective station and to rotate the disk to angular positions where the yarn is not dyed. A programmable controller directs the respective motors to the selected angular positions at precise times to start and stop the application of dye to the yarn. The controller is informed of the speed of the yarn movement so that rotation of each pattern disk is in timed relationship with the movement of the yarn. Other Superba space-dyeing machines which may be suitable include those disclosed in U.S. Pat. Nos. 5,557,953 and 5,491,858, which are incorporated herein by reference.

In each of the above embodiments, the space-dyeing takes place under the overall control of a computer based upon settings entered into the computer and transferred to the controller. The yarn speed may be continuously monitored and fed to the controller for adjusting the action of the servo motors in a corresponding fashion, or the yarn speed may be continuously monitored and maintained at a precise speed by means of a feedback loop between the nominal yarn speed value selected at the computer and the monitored speed.

Figure 3:
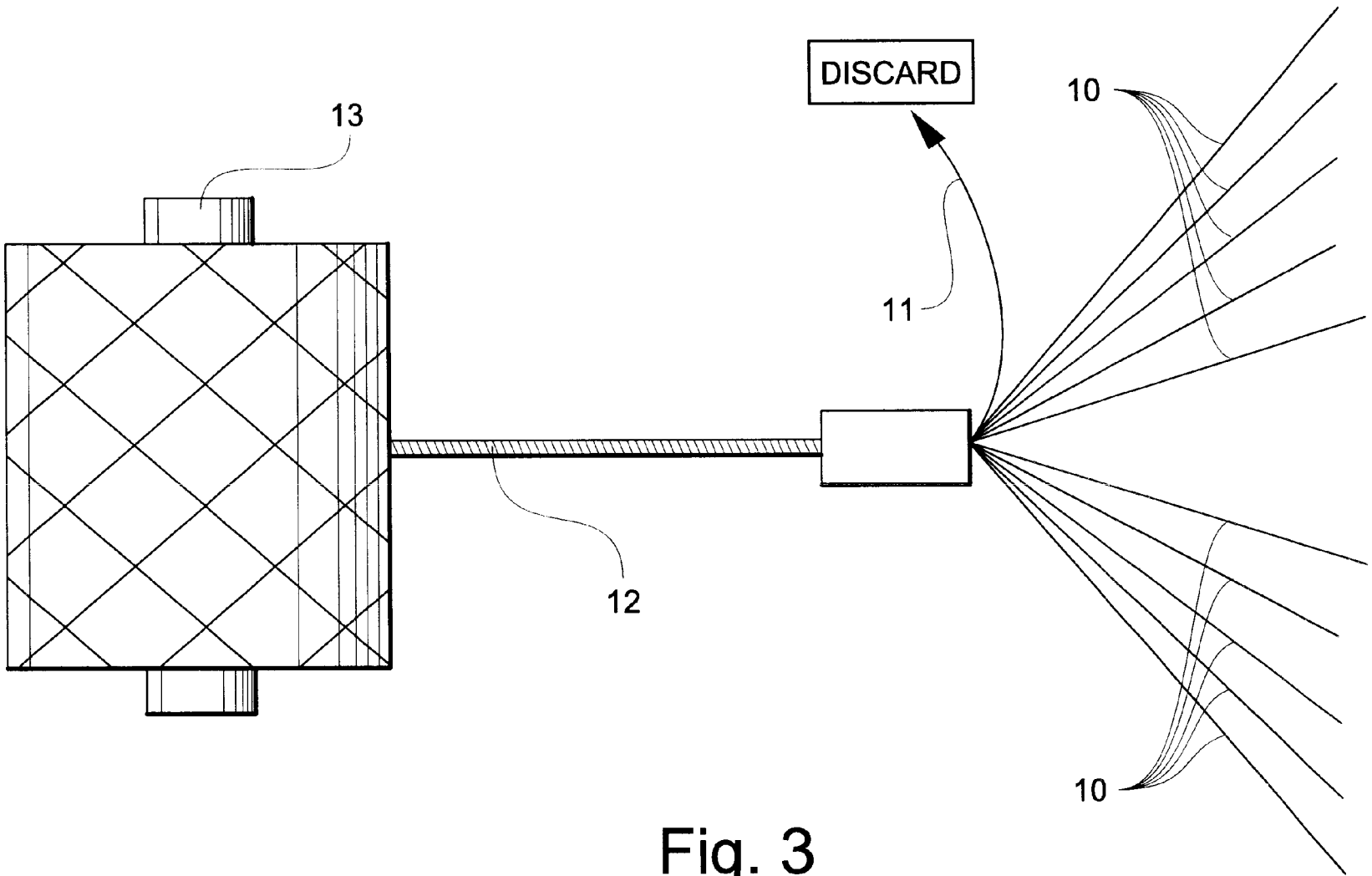
FIG. 3 is a schematic flow diagram showing the fine denier yarns being unwrapped and rewound onto individual packages.

After being space-dyed, the dyed, wound packages are removed from the winder 90 and placed on a conventional unwind stand 100, and unwrapped by removing the wrapper yarn 11 at an unwrapping apparatus 110 and separating the now-liberated feed yarns 10 into individual yarns for winding onto a standard package at a winder 120. See FIGS. 2 and 3. The sacrificial wrapper yarn 11 is disposed of by, for example, an aspirator jet 120 which conveys away the wrapper yarn 11 at a discard station 130.

Figure 4:
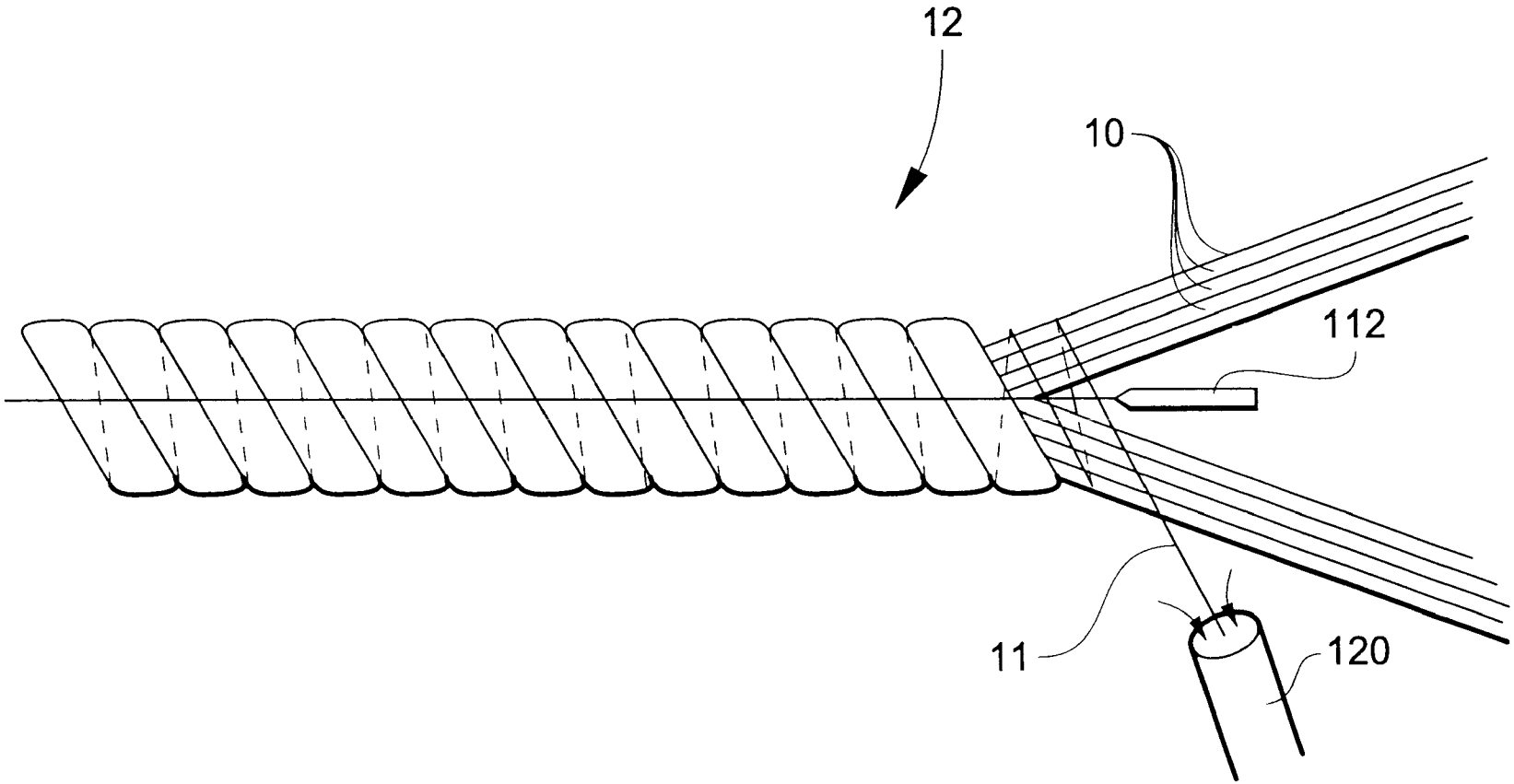
FIG. 4 is a schematic diagram showing a means of unwrapping the bundled yarn by cutting the wrapper yarn and carrying it away by means of an aspirator.

The wrapper yarn 11 may be removed at the unwrapping apparatus 1 10 in a number of ways. As is shown in FIG. 4, a knife blade 112 may be used to cut the wrapper yarn 11 away from the yarn bundle 12. This is accomplished by spreading the bundle 12 to form a v-shaped gap in the feed yarns 10 and exposing the wrapper yarn 11 to the blade 112. The blade 112 cuts the wrapper yarn 11 as the yarn bundle 12 is continuously spread immediately in advance of the blade 112. The space-dyed feed yarns 10 are separated and carried away from the cutting area while separated by a series of laterally-spaced separation pins at unwrapping and separating apparatus 110 for further processing.

Figure 5:
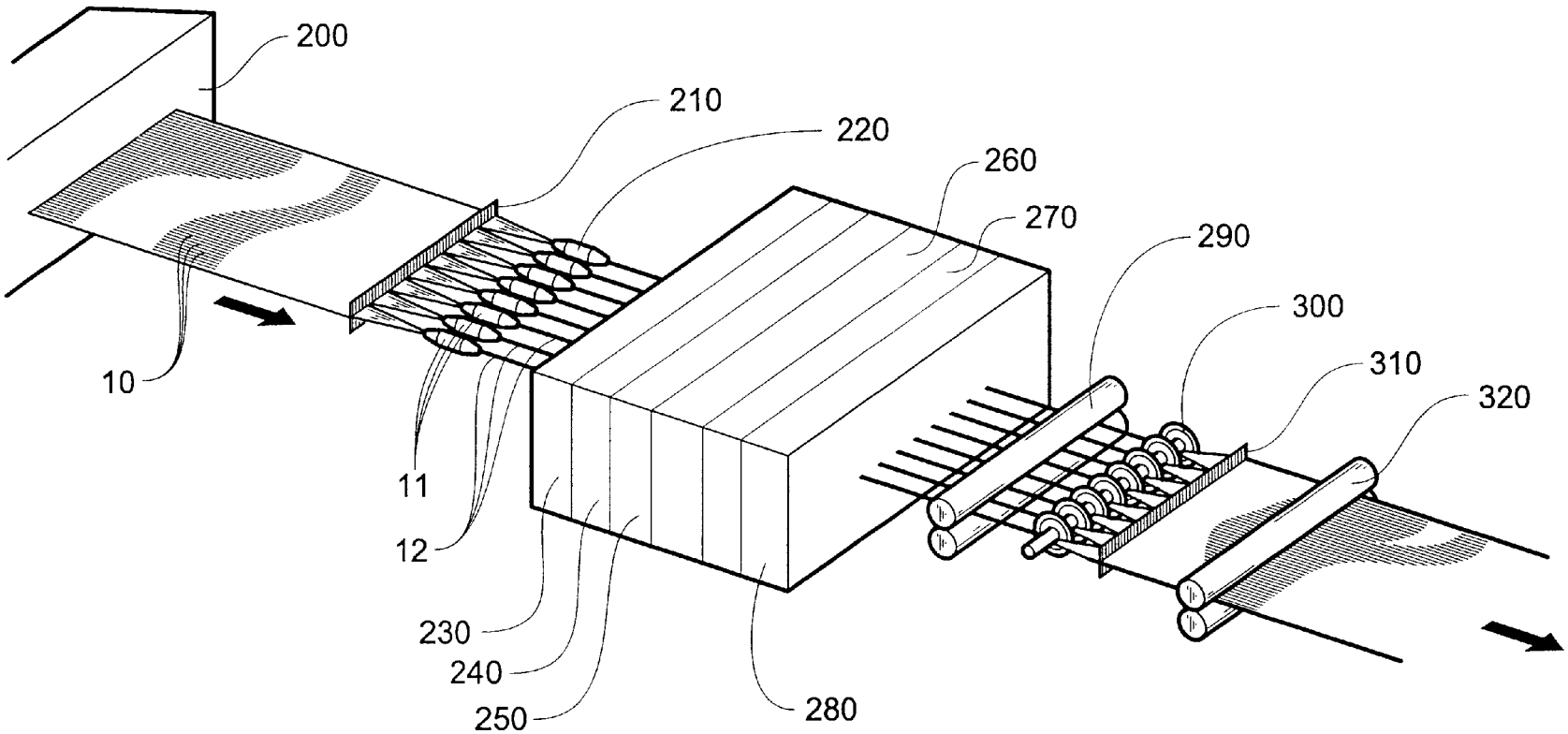
FIG. 5 is a schematic diagram showing a continuous process for carrying out the steps set out in FIGS. 1–4.

As is shown in FIG. 5, the overall steps of the method can be carried out continuously. In so doing, the yarns 10 are brought from a creel 200 and pass through separation pins 210 and are brought together and wrapped with a fine denier wrapper yarn 11 to form a composite yarn bundle 12, as described above. In order to form the warp of yarns which passes through the space-dyeing machine, a parallel array of yarn wrapping devices 220, which may be false-twist devices, form the composite yarn bundles 12 in a parallel array and deliver them to a space-dyeing apparatus 230. After dyeing, the warp of ccc pass through a post-dye steamer 240, coiler 250, steamer 260, washer, extractor 270 and dryer 280. Thereafter, the ccc pass through a pair of hold-back rolls 290 and then a series of laterally-spaced, disk-shaped rotating blades 300. The blades 300 are used to sever the wrapper yarns 11 of the respective yarn bundles 12. As described above, this is accomplished by spreading the bundle 12 to form a gap in the feed yarns 10, thus exposing the wrapper yarn 11 to the rotating blade 300. Another set of separator pins 310 keeps the ccc separated during the cutting of the wrapper yarn 11. Tensioning rolls 320 maintain tension on the ccc in cooperation with the hold-back rolls 290. The unwrapped feed yarns 10 are delivered to a winder for winding in a conventional manner, and the wrapper yarn 11 is discarded.

A process for wrapping of fine denier yarns for space dyeing and subsequently unwrapping the fine denier yarns for further processing is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A method for space-dyeing yarns, comprising the steps of:

(a) wrapping a plurality of feed yarns with a sacrificial wrapper yarn to form a composite yarn bundle of indeterminate length with the yarn bundle bound together along its length by wraps of the sacrificial wrapper yarn extending along the length of the yarn bundle to form a continuum of the wrapper yarn and the feed yarns;

(b) space-dyeing the composite yarn bundle;

(c) removing the wrapper yarn from around the feed yarns; and (d) separating the feed yarns into individual yarns for further processing.

2. A method according to claim 1, and including the step of winding the composite yarn bundle onto a yarn package after the space-dyeing step.

3. A method according to claim 1, wherein the step of removing the wrapper yarn from around the feed yarns comprises the step of unwrapping the wrapper yarn from around the feed yarns.

4. A method according to claim 1, wherein the step of removing the wrapper yarn from around the feed yarns comprises the step of cutting the wrapper yarn away from the feed yarns.

5. A method according to claim 4, and including the steps of:

(a) spreading the composite yarn bundle to expose the wrapper yarn in advance of the feed yarns to a blade; and (b) cutting the wrapper yarn away from the feed yarns at a point in advance of the feed yarns.

6. A method according to claim 4 or 5, and including aspirating the cut wrapper yarn to remove it from the feed yarns.

7. A method according to claim 6, and including the step of winding the separated feed yarns onto individual yarn packages.

8. A method according to claim 1, wherein the process steps are carried out in a continuous process on a single apparatus having a series of process stations.

9. A method according to claim 1, wherein the process steps are carried out in a series of discrete steps on separate machines.

10. A method according to claim 1, and including the steps of coiling, steaming and dyeing the composite yarn bundle after space-dyeing and before separating the wrapper yarn from the feed yarns.

11. A method according to claim 1, wherein each of the plurality of feed yarns comprises a synthetic yarn having a denier of 500 or less.

12. A method according to claim 1, wherein each of the plurality of feed yarns comprises a synthetic yarn having a denier of 150 or less.

13. A method according to claim 1, wherein the step of wrapping a plurality of feed yarns with a sacrificial wrapper yarn comprises the step of wrapping the feed yarns with between 2 and 10 wraps of the wrapper yarn per inch.

14. A method according to claim 11, 12 or 13, wherein the wrapper yarn comprises a yarn having a denier of between 20 and 150 denier.

15. A method according to claim 1, wherein the step of space-dyeing the composite yarn bundle comprises the step of passing the composite yarn bundle through a plurality of yarn-dyeing stations, each of said yarn dyeing stations including a rotatable pattern member permitting a dye to be applied to the yarn in seriatim only when disposed in a selected angular disposition relative to said yarn bundle, each pattern member being associated with a different color dye, the speed of each member controlling the angle through which each of the members rotates during repetitive time periods so that the disposition required to permit dyeing of yarn by each color may be obtained at selected times.

16. A method according to claim 15, and including the step of coordinating the location along the yarn bundle at which each member permits dye to be applied, whereby each different color dye may be applied along different amounts of the yarn bundle and at selected locations.

17. A method according to claim 1, wherein the step of space-dyeing the composite yarn bundle comprises the steps of:

(a) feeding said yarn bundle in one direction through said stations;

(b) locating a dye applying means at each station for applying dye of a selected color onto said yarn bundle, and (c) locating a rotatable pattern member at each station for selectively permitting and preventing dye to be applied to said yarn bundle by the respective dye applying means, and controllably rotating each pattern member independently of the other pattern members in accordance with a pattern to selected positions to permit dye to be applied to said yarn at selected times and to prevent dye to be applied to the yarn at other times.

18. An apparatus for space-dyeing yarns, comprising:

(a) an yarn-wrapping apparatus for wrapping a plurality of feed yarns with a sacrificial wrapper yarn to form a composite yarn bundle;

(b) a space-dyeing apparatus for space-dyeing the composite yarn bundle;

(c) a wrapper yarn removal apparatus for removing the wrapper yarn from around the feed yarns; and (d) a feed yarn separating apparatus for separating the feed yarns into individual yarns for further processing.

19. An apparatus for space-dyeing yarns according to claim 18, and including a winder for winding the composite yarn bundle onto a yarn package after the space-dyeing step and in advance of the wrapper yarn removal apparatus.

20. An apparatus for space-dyeing yarns according to claim 18, wherein the apparatus for removing the wrapper yarn from around the feed yarns comprises an apparatus for unwrapping the wrapper yarn from around the feed yarns.

21. An apparatus for space-dyeing yarns according to claim 18, wherein the apparatus for removing the wrapper yarn from around the feed yarns comprises a cutter blade for cutting the wrapper yarn away from the feed yarns.

22. An apparatus for space-dyeing yarns according to claim 21, wherein the apparatus for removing the wrapper yarn from around the feed yarns includes a yarn bundle spreader for spreading the composite yarn bundle to expose the wrapper yarn in advance of the feed yarns to a blade and wherein the cutter blade cuts the wrapper yarn away from the feed yarns at a point in advance of the feed yarns.

23. An apparatus for space-dyeing yarns, and comprising:

(a) yarn wrapping means for wrapping a plurality of feed yarns with a sacrificial wrapper yarn to form a composite yarn bundle;

(b) space-dyeing means for space-dyeing the composite yarn bundle;

(c) wrapper yarn removal means for removing the wrapper yarn from around the feed yarns; and (d) separator means for separating the feed yarns into individual yarns for further processing.

24. An apparatus according to claim 23, and including winding means for winding the composite yarn bundle onto a yarn package after the space-dyeing step and in advance of the wrapper yarn removal apparatus.

25. An apparatus according to claim 24, wherein the wrapper yarn removal means comprises a cutter blade for cutting the wrapper yarn away from the feed yarns.

26. An apparatus according to claim 23, and including wrapper removal means for removing the wrapper yarn from around the feed yarns comprises the step of unwrapping the wrapper yarn from around the feed yarns.

27. A composite yarn bundle for permitting space-dyeing of fine denier yarns, comprising:

(a) a plurality of fine denier feed yarns integrated together in parallel configuration to form an integrated core; and (b) a sacrificial wrapper yarn wrapped around the core to form a composite yarn bundle wherein the feed yarns are maintained in integrated condition during space-dyeing, said sacrificial wrapper adapted to be removed from around the feed yarns after space-dyeing to permit separation of the core into individual feed yarns for subsequent processing.

28. A composite yarn bundle according to claim 27, wherein each of said feed yarns is 500 denier or less.

29. A composite yarn bundle according to claim 27, wherein each of said feed yarns is 150 denier or less.

30. A composite yarn bundle according to claim 27, wherein each of said feed yarns is 50 denier or less.

31. A composite yarn bundle according to claim 27, wherein the wrapper yarn is 50 denier or less.

32. A composite yarn bundle according to claim 27, wherein the wrapper yarn is wrapped onto the core with between 2 and 10 wraps per inch.

33. A space-dyed, fine denier yarn, comprising:

(a) a feed yarn of no more than 500 denier;

(b) a plurality of colors of dye applied to the feed yarn by moving the feed yarn past a dye-applying apparatus while integrated together with a plurality of like feed yarns by means of at least one sacrificial wrapper yarn wrapped around said feed yarns to maintain the feed yarns in their integrated condition, said wrapper yarn being removed from the feed yarn after space-dyeing.

* * * * *